US006369843B1

(12) United States Patent
Springett et al.

(10) Patent No.: US 6,369,843 B1
(45) Date of Patent: Apr. 9, 2002

(54) TRANSFER SHEET PRINTING PROCESS FOR DECORATING ARTICLES FORMED BY USING A DIGITALLY CONTROLLED COLOR PRINTING MACHINE

(75) Inventors: Brian E. Springett; Donald G. Monefeldt, both of Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/454,834

(22) Filed: Dec. 6, 1999

(51) Int. Cl.[7] ..... B41J 2/32; B41J 2/01; B41J 2/21

(52) U.S. Cl. ..... 347/173; 347/212

(58) Field of Search ..... 347/173, 171, 347/212, 213, 174, 176, 111, 112, 114, 115, 117, 118, 1, 2, 3; 400/120.18; 8/467, 471; 399/297, 298, 299

(56) References Cited

U.S. PATENT DOCUMENTS 4,685,984 A 8/1987 Powers et al. ..... 156/155
4,773,953 A 9/1988 Hare ..... 156/240
5,512,930 A * 4/1996 Brandt et al. ..... 400/120.18

FOREIGN PATENT DOCUMENTS

WO WO 97/21867 6/1997

* cited by examiner

*Primary Examiner*—Huan Tran

(57) ABSTRACT

A transfer sheet capable of applying a colored pattern to a final support material through the application of heat and pressure. The transfer sheet includes a carrier sheet having a colored pattern printed on a surface thereof. A digitally controlled color printer is used to print a colored pattern on the surface of the carrier sheet. A layer of white colored material is printed over at least the color pattern with a digitally controlled color printer. A layer of glue is deposited over the layer of white colored material. The layer of glue may also be printed over the white colored material by the digitally controlled color printer, or by a separate device, if required.

30 Claims, 2 Drawing Sheets

Figure 1:
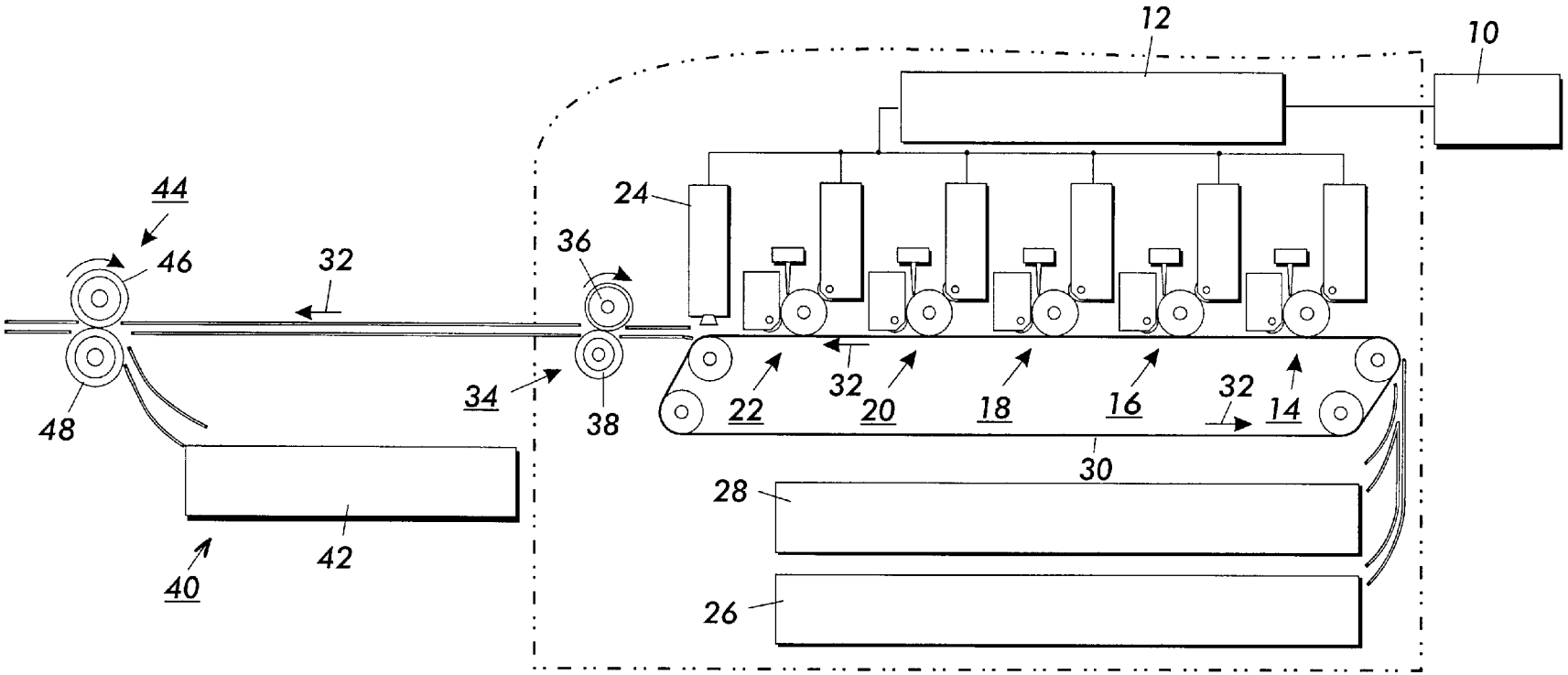

TRANSFER SHEET PRINTING PROCESS FOR DECORATING ARTICLES FORMED BY USING A DIGITALLY CONTROLLED COLOR PRINTING MACHINE

This invention relates generally to a transfer sheet and the apparatus and method used to form the transfer sheet. More particularly, this invention relates to a transfer sheet formed by using a digitally controlled color printer.

It is known to decorate textiles by printing patterns in various colors by a suitable printing method, such as the silk screen process. In a typical silk screen printing process, each individual color is applied to a sheet of silicon paper. An adhesive layer is applied thereover. Thereafter, the transfer sheet is pressed against the fabric with heat being applied to effectuate the transfer of the colored pattern from the transfer sheet to the fabric. Heretofore, color copiers have been used to print color images on a thermoplastic coated transfer paper. The color images printed on the paper are then transferred by heat impression to cotton textiles. A typical digitally controlled color printer is an electrophotographic printing machine or an ink jet printing machine.

In an electrophotographic printing machine, a photoconductive member is charged to a substantially uniform potential so as to sensitize the surface thereof. The charged portion of the photoconductive member is exposed to a digitally controlled light image corresponding to the desired print being reproduced. Exposure of the charged photoconductive member selectively dissipates the charge thereon in the irradiated areas to record an electrostatic latent image on the photoconductive member corresponding to the informational areas contained within the document being printed. After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image forming a visible toner powder image on the photoconductive member. After the electrostatic latent image is developed with toner particles, the toner powder image is transferred to a sheet. Thereafter, the toner powder image is heated to permanently fuse it to the sheet.

In forming a transfer sheet which will be used to create a color print on another substrate, it is necessary to use a color electrophotographic printing machine or a color ink jet printing machine. Color electrophotographic printing machines produce a color print by forming yellow, magenta, cyan, and black color separations. There are many variations of color electrophotographic printing machines. For example, there is a single pass color electrophotographic printing machine and a multi-pass electrophotographic printing machine. In one type of a single pass electrophotographic printing machine, successive different color images are developed on the photoconductive belt in superimposed registration and transferred to the sheet in registration with one another. Each image is formed and developed on the photoconductive belt in a single cycle of operation. In another type of single pass electrophotographic printing machine, successive photoconductive members transfer different color images to an intermediate belt or to the sheet, in registration with one another. When an intermediate belt is used, the composite image is transferred from the belt to the sheet. Alternatively, in a multi-pass electrophotographic printing machine, successive different color images are on the photoconductive belt in successive cycles. Thus, it requires multiple cycles to form the composite multicolor image on the photoconductive belt. This composite image is then subsequently transferred to the sheet and fused thereto.

Multi-pass and single pass printing machines are described in U.S. Pat. No. 5,666,612, issued to Beachner, et al., on Sep. 9, 1997, the relevant portions thereof being hereby incorporated into the present application. Still another specific type of electrophotographic printing machine which is adapted to produce color prints is a tandem printing machine. In a tandem color printing machine, successive color engines are positioned along a sheet path. Each color engine includes a photoconductive drum which is exposed to digitally controlled single color light images. These single color light images are developed by the appropriately colored toner particles. After development, the toner powder image is transferred to the sheet advancing on a belt, or alternatively to an intermediate belt. Successive engines of this type are positioned along the belt with each engine forming a different color toner powder image which is transferred to the common sheet, in superimposed registration with one another, to form the multicolor image thereon. The resultant composite multi-color toner image is then fused to the sheet. A multi-color printing machine of this type is sold by the Xerox Corporation under the Model No. DocuColor 40. Finally, there are various types of color ink jet products which produce color prints. For example, Tektronix Corporation Model Phaser 840 utilizes solid ink which is melted, and, using piezoelectric print heads, sprayed onto a sheet in superimposed registration to form a color print. Color printing machines of the type heretofore described produce prints having a resolution ranging from about 400 to about 600 dots/inch (dpi). These prints approach photographic quality. However, none of these printing machines form a white underlayer for the color image. This is essential when transferring the color pattern to a non-white fabric or textile.

Thus, it is apparent that it would be highly desirable to be able to utilize a color electrophotographic printing machine having high resolution to produce transfer sheets which may be used to decorate articles such as fabrics. Heretofore, there have been various attempts to utilize electrophotographic printing machines, however, all of these attempts have resulted in hybrid systems, i.e., the use of two different printing technologies to achieve the final transfer sheet, with a white colored underlayer. The following disclosures appear to be relevant:

WO-97/21867

Applicant: Franke

Publication Date: Jun. 19, 1997

U.S. Pat. No. 4,685,984

Patentee: Powers, et al.

Issued: Aug. 11, 1987

U.S. Pat. No. 4,773,953

Patentee: Hare

Issued: Sep. 27, 1988

The following is a discussion of the foregoing, which are incorporated hereby by reference, and which may be relevant to the present invention:

WO-97/21867 discloses a sheet of paper or heat resistant plastic sheet coated with a thin release layer of silicone or polyolefin. A first transparent elastomer layer is configuratively printed by silk screen printing on the silicone or polyolefin surface, and, on top of the elastomer surface, a one or multi-colored pattern is printed with a digitally controlled color printer. On top of the colored pattern, a second transparent elastomer layer is configuratively printed again by silk screen printing, and, in the same manner, a white-pigmented elastomer layer is printed on the second elastomer layer. Uppermost, a heat activatable, thermoplastic polymeric glue layer is applied thereon.

U.S. Pat. No. 4,685,984 describes a process for transferring indicia from paper to a fabric backing member. An indicia carrier layer of tacky, contact adhesive is bonded to the backing member by a thermoplastic elastomer layer. A combination of webs involved in the transfer process is supported through the steps, including water wash and at least the initiation of fusing, by a temporary support layer of heat resistant, water-impervious polymers, having a non-silicone high release coating. Heat and pressure are applied through this layer to firmly fuse the thermoplastic elastomer layer along with the carrier layer and the indicia to the backing member prior to stripping of the temporary support layer. The firm fusing and release action established by the non-silicone high release coating prevent distortion or destruction of any portion of the indicia during the stripping step.

U.S. Pat. No. 4,773,953 describes a method for creating personalized, creative designs or images on a fabric using a personal computer system. The design is first created by hand on the monitor screen of the computer system. This design is then printed onto a heat transfer sheet. The design is then ironed onto the fabric. The design may be an image, such as a picture, created by a video camera.

In accordance with one aspect of the present invention, there is provided a transfer sheet including a carrier sheet. A colored pattern is printed on a surface of the carrier sheet using at lease one digitally controlled color printer. A layer of white colored material is printed over at least the colored pattern using the digitally controlled printer.

In still another aspect of the present invention, there is provided an apparatus for transferring a colored pattern from a carrier sheet to a final support material. The apparatus includes at least one digitally controlled color printer for printing the colored pattern on a surface of the carrier sheet. The printer prints a white colored material over at least the colored pattern.

Yet another aspect of the present invention is a method of transferring a colored pattern from a carrier sheet to a final support material. The method includes using at least one digitally controlled printer to print the colored pattern on a surface of the sheet and to print a white colored material over at least the colored pattern.

Figure 2:
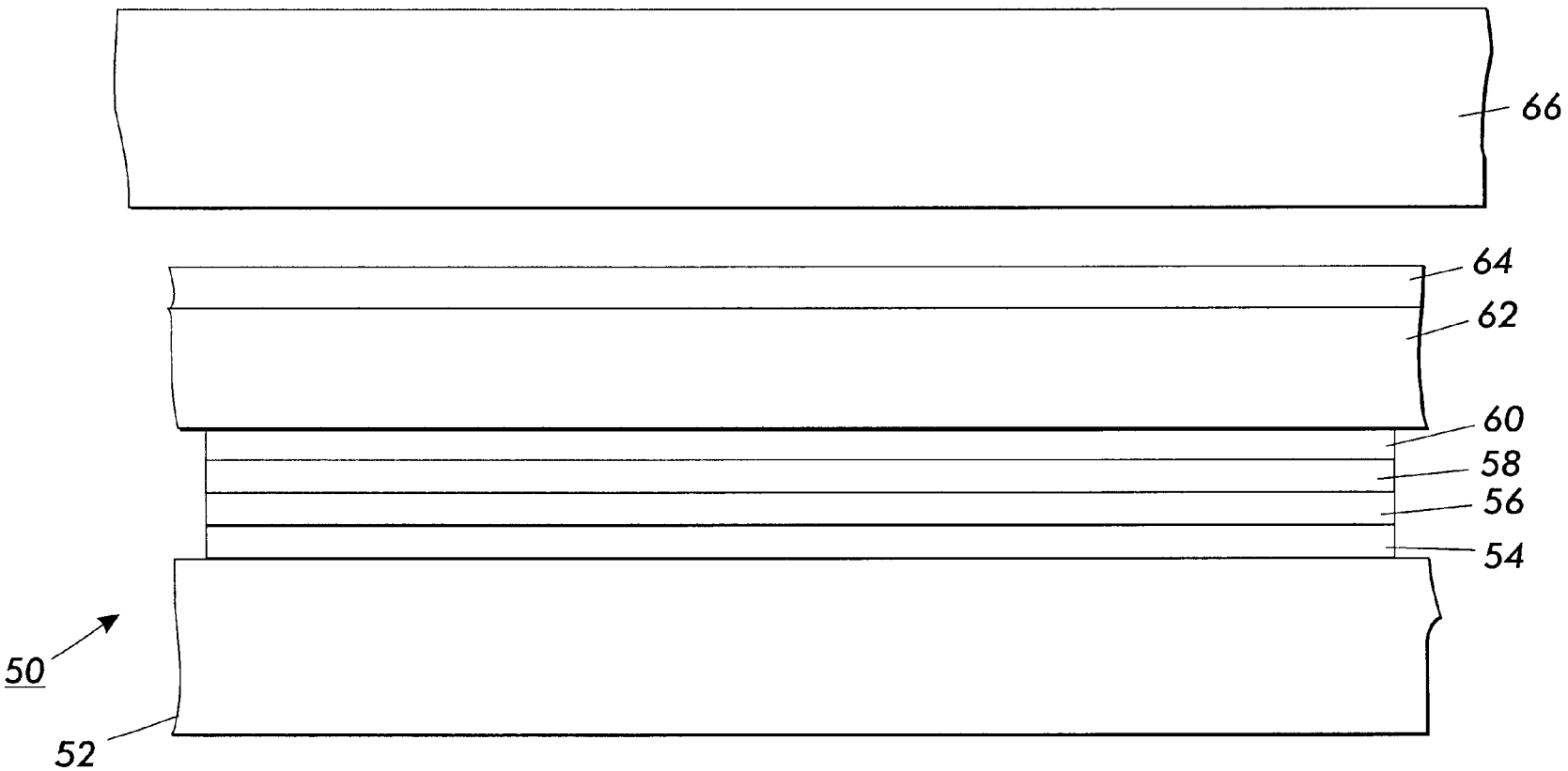

Other aspects of the present invention will become apparent as the following description proceeds, and upon reference to the drawings, in which:

FIG. 1 a schematic, elevational view showing an exemplary multi-color electrophotographic printing machine incorporating the features of the present invention there; and FIG. 2 illustrates schematically a transfer sheet printed with the printing machine shown in FIG. 1.

While the present invention hereinafter will be described in connection with a preferred embodiment and method of use, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements.

A classic silk screening process involves color separations, film, and screen creation at low resolution, i.e., about 100 dots per inch. This is followed by a multi-pass silk screen printing with conventional solvent based inks. Most inks currently being employed are solvent based to prevent environmental problems. It is highly desirable to be capable of significantly improving the resolution and to utilize a single printing process, as well as eliminating the negative environmental impacts.

Turning now to FIG. 1, there is shown an illustrative digitally controlled multi-color electrophotographic printing machine. One skilled in the art will appreciate that many other types of multi-color electrophotographic printing machines may be employed, such as any type of single pass, multipass, electrophotographic printing machines. Also, various types of multi-color ink jet printing machines may also be used to form the transfer sheet of the present invention.

With continued reference to FIG. 1, the exemplary electrophotographic printing machine is electrically connected to an image data source, indicated generally by the reference numeral 10, which may be a personal computer or the equivalent. Image data source 10 generates the electronic image which is transmitted to the multi-color electrophotographic printing machine. More particularly, this electronic data is processed by raster image processor 12. The raster image processor 12 transmits electronic signals to respective raster output scanners (ROS) of each printing engine. As shown FIG. 1, there are five printing engines, indicated generally by the reference numerals 14, 16, 18, 20 and 22. Print engine 14 forms a cyan image. Print engine 16 forms a magenta image. Print engine 18 forms a yellow image, and print engine 20 forms a black image. One skilled in the art will appreciate that the order of printing these colors may be altered and any suitable printing sequence may be used. Furthermore, colors may be omitted or changed, and additional print engines used to provide additional colors. Finally, print engine 22 forms a white image. A glue layer applicator, 24, is located after print engine 22. Glue applicator 24 may also be a print engine.

Turning to print engine 14, print engine 14 employs a photoconductive drum which rotates through the various printing stations therein. Initially, the photoconductive drum passes through a charging station. At the charging station, a corona generating device or any other suitable charging device charges the photoconductive surface of the drum to a relatively high, substantially uniform potential. After the drum is charged, the charged portion thereof is advanced to the exposure station. At the exposure station, an imaging beam is generated by a raster output scanner (ROS) which illuminates the charged portion of the photoconductive drum. The ROS employs a laser with rotating polygon mirror blocks to create the electrostatic latent image on the photoconductive surface of the drum. Alternatively, a light emitting diode (LED) imaging system may be used. This electrostatic latent image is then developed as the drum rotates through the development station. The development station includes a magnetic brush developer unit, or any other suitable development system, which deposits cyan toner particles on the electrostatic latent image. In this way, the electrostatic latent image is developed with a cyan colored material. After the cyan toner image has been developed on the photoconductive drum, the photoconductive drum continues to rotate to the transfer station. At the transfer station, a sheet of support material is advanced from a stack 26 or 28. In either case, the sheet of support material is advanced to the transfer station at print engine 14. A corona generating device or any other suitable charging device, sprays an electric charge onto the back side of the sheet of support material. This attracts the developed cyan image from the photoconductive drum to the sheet of support material. A vacuum transport 30 moves the sheet of support material in the direction of arrow 32 to the next successive print engine 16.

At print engine 16, a magenta colored image is transferred to the sheet of support material in superimposed registration with the cyan toner image. Print engine 16 is substantially the same as print engine 14. Print engine 16 employs a photoconductive drum which is initially charged as it passes through a charging station. At the charging station, a corona generating device, or any other suitable charging device, charges the photoconductive drum to a relatively high, substantially uniform potential. After the photoconductive drum is charged, the charged portion thereof is advanced to an exposure station. At the exposure station, an imaging beam, generated by an raster output scanner (ROS) illuminates the charged portion of the photoconductive drum. The ROS employs a laser with rotating polygon mirror blocks to create the electrostatic latent image on the photoconductive drum. Alternatively, an LED imaging system may be used. This electrostatic latent image is developed at the development station. The development station includes a magnetic brush developer unit or any other suitable development system which deposits magenta toner particles on the electrostatic latent image. In this way, the magenta toner particles develop the magenta portion of the latent image. Previously, the cyan portion of the latent image has been developed at print engine 14. After the magenta toner particles have been developed on the photoconductive drum, the drum continues to rotate to the transfer station. At the transfer station, the sheet of support material, advancing in the direction of arrow 32 on vacuum belt 30, receives the magenta toner powder image thereon, at least partially in superimposed registration with the cyan toner powder image transferred thereto at printing station 14. The sheet of support material on belt 30 continues to advance in the direction of arrow 32 to print engine 18.

Print engine 18 is substantially identical to print engines 14 and 16. However, print engine 18 develops a yellow color separated electrostatic latent image with yellow toner particles. Print engine 18 employs a photoconductive drum which rotates through the printing stations thereof. Initially, the photoconductive drum passes through a charging station. At the charging station, a corona generating device or any other suitable charging device charges the photoconductive drum to a relatively high, substantially uniform potential. After the photoconductive drum is charged, the charged portion thereof is advanced to an exposure station. At the exposure station, an imaging beam, generated by a raster output scanner (ROS) illuminates the charged portion of the photoconductive drum. The ROS employs a laser with rotating polygon mirror blocks to create the electrostatic latent image on the photoconductive drum. Alternatively, an LED imaging system may be used. This electrostatic latent image is a yellow color separated latent image. Previously, cyan color separated images and magenta color separated images have been created and developed at print engines 14 and 16, respectively. With continued reference to print engine 18, the photoconductive drum advances the yellow electrostatic latent image to the development station. At the development station, a magnetic brush developer unit or any other suitable development system deposits yellow toner particles on the electrostatic latent image. In this way, the yellow toner particles develop the latent image. After the yellow toner image has been developed on the photoconductive drum, the drum continues to advance to the transfer station. At the transfer station, the sheet of support material being advanced on belt 10 in the direction of arrow 32 from printing station 16, passes through the transfer station of print engine 18. At the transfer station, a corona generating device or any other suitable charging device sprays electric charge onto the back side of the sheet of support material. This attracts the yellow toner image from the photoconductive drum to the sheet of support material, in superimposed registration, at least partially, with the cyan and magenta toner powder images previously transferred thereto. Thereafter, the sheet of support material on belt 30 continues to advance, in the direction of arrow 32, to print engine 20.

At print engine 20, a black color separated electrostatic latent image is formed and developed with black toner particles. Print engine 20 includes a photoconductive drum which initially rotates through a charging station. At the charging station, a corona generating device or any other suitable charging device charges the photoconductive drum to a relatively high, substantially uniform potential. After the photoconductive drum is charged, the charged portion thereof is advanced to an exposure station. At the exposure station, an imaging beam, generated by a raster output scanner (ROS) illuminates the charged portion of the photoconductive drum. The ROS employs a laser with rotating polygon mirror blocks to create a black color separated electrostatic latent image on the photoconductive drum. Alternatively, an LED imaging system may be used. This electrostatic latent image is developed at the development station. The development station includes a magnetic brush developer unit or any other suitable development system which deposits black toner particles on the black color separated electrostatic latent image. In this way, black toner particles develop the latent image. After the toner image has been developed on the photoconductive drum, the photoconductive drum continues to advance to the transfer station. At the transfer station of print engine 20, the sheet of support material advancing on belt 30 in the direction of arrow 32 receives the black toner powder image. This is achieved by a corona generating device or any other suitable charging device which sprays electric charge onto the back side of the sheet of support material. This attracts the black developed image from the photoconductive drum to the advancing sheet of support material.

After receiving the black toner image, the sheet of support material continues to advance in the direction of arrow 32 on belt 30. At this point in the printing operation, the completed multi-color pattern has been formed on the advancing sheet of support material. Thus, the resultant multi-color pattern may be fused to the sheet of support material at this point or subsequent thereto after passing through glue applicator 24. For purposes of illustration, fusing apparatus 34 will be described after the sheet of support material passes through the glue applicator 24.

After the multi-color pattern has been transferred to the sheet of support material advancing in the direction of arrow 32 on belt 30, the sheet advances to white print engine 22. At white print engine 22, a photoconductive drum is initially charged as it passes through the charging station. At the charging station, a corona generating device or any other suitable charging device charges the photoconductive drum to a relatively high, substantially uniform potential After the photoconductive drum is charged, the charged portion thereof is advanced to an exposure station. At the exposure station, an imaging beam, generated by a raster output scanner (ROS) illuminates the charged portion of the photoconductive surface. The ROS employs a laser with rotating polygon mirrors to create a white electrostatic latent image on the photoconductive drum. Alternatively, an LED imaging system may be used. However, in contradistinction to the electrostatic images formed by the cyan, magenta, yellow, and black print engines, this white electrostatic latent image is a substantially uniformly discharged charged region whose boundaries are defined by the outline of the just formed four color image. In this way, white toner particles are attracted to the entire latent image. Thus, a white toner particle image is formed covering the entire latent image recorded on the photoconductive drum. This white electrostatic latent image is developed at the development station which deposits white toner particles on the electrostatic latent image. In this way, a substantially uniform, white toner powder image is formed on the photoconductive drum, After the white electrostatic latent image has been developed on the photoconductive drum, the photoconductive drum advances to the transfer station. A sheet of support material, or carrier sheet having the multi-color pattern transferred thereto advances to the transfer station of print engine 22. As previously notes, this multi-color pattern transferred to the carrier sheet may have been fused thereto or may remain unfused as it advances to the transfer station of print engine 22. At the transfer station, a corona generating device or any other suitable charging device sprays electric charge onto the backside of the carrier sheet. This attracts the white toner particles from the photoconductive drum to the carrier sheet in superimposed registration with at least the multi-color pattern transferred to the carrier sheet previously.

It should be noted that if the multi-color pattern has been fused to the carrier sheet prior to the transfer of the white toner particles thereto, a second fuser unit is required subsequent to transferring the layer of glue thereto so as to dry the layer of white toner particles and the glue on the carrier sheet.

One skilled in the art will appreciate that the white print engine, while having been described as an electrophotographic print engine, may also be a suitable ink jet print engine. Similarly, print engines 14, 16, 18, and 20 ay also be various types of ink jet print engines. Thus, it is apparent that the digital print engines may all be of the same type or may be mixed depending upon the desired advantageous properties of each print engine with respect to the formation of the transfer sheet. One skilled in the art will also appreciate that for printing on a white textile or other fabric, the white layer may be omitted.

After the white toner particle layer has been transferred to the carrier sheet, the carrier sheet continues to advance in the direction of arrow 32 on belt 30 to glue applicator or print engine 24.

Glue print engine 24 may be of the type described heretofore with respect to print engines 14 through 22, inclusive. More particularly, glue print engine 24, if an electrophotographic print engine, will be substantially identical to white print engine 22, with the only distinction being that rather than developing the latent image with white toner particles, glue particles will be used to develop the latent image and transferred to the carrier sheet over the layer of white toner particles previously transferred thereto at print engine 22. After the layer of glue has been deposited over the layer of white toner particles, the sheet continues to advance in the direction of arrow 32 to fusing station 34.

One skilled in the art will appreciate that the white layer of toner or ink may be designed to incorporate therein the adhesive properties of the glue layer. In this embodiment a separate layer of glue is not required.

At fusing station 34, a heated fuser roll 36 and a back up of pressure roll 38 cooperate with one another to fuse the multi-color pattern to the carrier sheet and dry the layer of white toner particles and glue applied thereover. Back up or pressure roll 38 is resiliently urged into engagement with fuser roll 36 to form a nip through which the carrier sheet passes. In the fusing operation, the toner particles coalesce and bond to the sheet in image configuration forming a multi-color image thereon. After passing through fusing station 34, the resultant transfer sheet is advanced to decoration station 40. One skilled in the art will appreciate that any suitable drying and/or fusing apparatus may be used.

At decoration station 40, a final support material receives the multi-color pattern on the transfer sheet. The final support material may be a fabric material, or any other type of article. In any event, a final support material is advanced from a stack 42 thereof to a transfer system 44. Transfer system 44 includes a pair of rollers 46 and 48, which receive the final support material and the transfer sheet in registration with one another. Rollers 46 and 48 apply heat and pressure to the sandwich formed by the transfer sheet and the final support material. The layer of glue on the transfer sheet is in contact with a surface of the transfer sheet. Thus, a sandwich is formed wherein the outer surfaces of the sandwich are the carrier sheet and the final support material with the multi-color pattern, white layer and glue layer being interposed therebetween. Rollers 46 and 48 apply sufficient heat and pressure to effectuate the transfer of the glue, white toner layer, and color pattern to the final support material. In this way, the final sheet of support material is decorated with the multi-color pattern. The glue layer adheres to the final support material. Superimposed over the glue layer is the white toner layer and disposed thereover is the multi-color pattern. Thus, the multi-color pattern is visible and secured to the final support material.

One skilled in the art will appreciate that decoration station 40 need not be included with the present apparatus. It may be highly desirable to manufacture transfer sheets in and of themselves, and at some subsequent time have the multi-color pattern transferred therefrom to a final support material. Thus, one skilled in the art will appreciate that the end product from the present invention may be a transfer sheet or may be the final support material having the multi-color image decorating it.

One skilled in the art will appreciate that while one printing machine has been described including forming the four color process color, and the white and glue layers, separate engines may be used for the process color, white and glue layers, or any suitable combination thereof may be used to produce the transfer sheet of the present invention. Furthermore, different colors may be used to achieve any suitable color variation, such as spot color and/or the resultant image being either monochrome or two color. Moreover, one skilled in the art will appreciate that more than four color stations may be used to achieve hexacolor printing such as Pantone, resulting in higher quality images.

One skilled in the art will appreciate that while the multi-color developed image, the white toner particles, and the glue, have all been disclosed as being transferred to a carrier sheet, they may be transferred to an intermediate member, such as a belt or drum, and then subsequently transferred to the carrier sheet. Furthermore, while toner powder images and toner particles have been disclosed herein, one skilled in the art will appreciate that a liquid developer material employing toner particles in a liquid carrier may also be used. Thus, the developer material employed in the printing machine may be either a dry developer material of carrier granules having toner particles adhering triboelectrically thereto, or a wet developer material of toner particles in a liquid carrier.

Referring now to FIG. 2, there will be described the transfer sheet of the present invention formed by the printing machine of FIG. 1. Transfer sheet 50 includes a carrier sheet or sheet of support material 52. By way of example, carrier sheet 52 is made from a sheet of paper or a heat-resistant plastic sheet coated with a thin release layer of silicone or polyolefin. A layer of cyan toner particles 54 is transferred imagewise to carrier sheet 52 in image configuration. Thereafter, the layer of magenta toner particles 56 is transferred imagewise, in registration over the cyan layer 54. Yellow layer 58 is disposed over the magenta layer 56 and cyan layer 54, imagewise, in registration. Finally, black layer 60 is disposed imagewise, in registration, over yellow layer 58, magenta layer 56, and cyan layer 54. Thus, the composite multi-color pattern is formed on carrier 52 and includes black layer 60, yellow layer 58, magenta layer 56, and cyan layer 54. By way of example, it is desirable to use small particle size toner particles to obtain finer resolution. Suitable toner particles range in size from about 5 microns to about 10 microns, with the smaller size particles giving higher resolution and thinner, more flexible images. The resolution achieved by a typical color electrophotographic printing machine is about 600 dpi or possibly higher. While toner particles have been described as forming the multi-color pattern on carrier 52, one skilled in the art will appreciate that inks may also be used and will be used when ink jet printers are employed rather than electrophotographic printing machines. After the multi-color pattern has been formed on carrier 52, a layer of white toner particles are transferred thereto superimposed imagewise, in registration over the color pattern so as to cover the four color image to its outer boundaries. This is a substantially uniform layer of toner particles forming a backing upon which the color pattern resides when transferred to the final support material. By way of example, the white toner particle layer extends to within about 0.5 mm of the edge of image boundary. Suitable white toner particles may be made from titanium dioxide and are about 5–10 microns in size.

Finally, a heat activatable thermoplastic polymeric glue layer 64 is printed over white layer 62. It should be noted that the desired multi-color pattern formed by layers 54, 56, 58, and 60 are printed in mirror-inverted fashion on carrier sheet 52 in order that, in particular, text is readable on transfer of the image. Further details of the various types of materials that may be employed are described in International Publication No. WO 97/21867, published Jun. 19, 1997, the relevant portions thereof being hereby incorporated into the present application. Resultant transfer sheet 50 may now be applied to a final support material 66. Final support material 66 may be any ordinary textile article. Decoration station 40, FIG. 1, will apply about 170 to 180° C. for the requisite period of time, which may be 8 to 12 seconds, and the requisite pressure, which may be about 300 kpa. Of course, the requisite temperature and pressure will depend upon the types of materials employed for the transfer sheet.

While a tandem engine multi-color electrophotographic printing machine has been described herein in detail, one skilled in the art will; appreciate that many other types of digitally controlled color printers may be employed. For example, Canon's CLC700, Ricoh's NC 5006, and Xerox's 5775 are other types of color electrophotographic printing machines that may be utilized. In addition, an example of a liquid electrophotographic type of printing machine that is suitable is the Indigo E Print 1000. Suitable ink jet printers are the Canon BJC-880 and the Tektronix Phaser 840. The foregoing are just examples of types of suitable digitally controlled color printers. One skilled in the art will appreciate that there are many other types of digitally controlled color printers which may be employed in the present invention and are suitable to achieve the advantageous results hereof.

One skilled in the art will appreciate that a clear transparent layer may be initially formed on carrier 52 prior to the formation of the multicolor image. In this embodiment, an additional printing station located prior to the color printing stations printing an imagewise clear layer. This clear layer protects the colored image from, for example, harsh laundering or abrasive environments.

In recapitulation, it is clear that the present invention is directed to a transfer sheet which is formed by a digitally controlled color printer. Each layer of the transfer sheet is formed by the color printer. The transfer sheet includes a carrier sheet having layers of cyan, magenta, yellow, and black toner particles formed thereon in image configuration to produce a composite, multi-color pattern. A layer of white toner particles is deposited over the composite multi-color pattern on the carrier sheet. Finally , the outermost layer of the transfer sheet is a layer of adhesive or glue. Each layer, including the white layer, is formed by a digitally controlled color printer. Furthermore, the glue layer may also be formed by the digitally controlled printer. Thus, the color printer may be an electrophotographic printing machine of any type or an ink jet printing machine of any suitable type.

It is, therefore, apparent that there has been provided in accordance with the present invention, a transfer sheet and an apparatus and is method for forming the transfer sheet which fully satisfies the aims and advantages hereinbefore set forth. While this invention has been described in conjunction with a specific embodiment and method of use thereof, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. An apparatus for transferring a colored pattern from a carrier sheet to a final support material, including at least one digitally controlled color printer for printing the colored pattern on a surface of the carrier sheet, said printer printing a white colored material over at least the colored pattern.

2. An apparatus according to claim 1 further including a glue applicator, associated with said printer, for depositing a layer of glue over at least the layer of white colored material.

3. An apparatus according to claim 2 wherein said glue applicator includes a digitally controlled printing station, associated with said printing machine, for depositing the layer of glue over the layer of white colored material.

4. An apparatus according to claim 2, wherein glue being deposited by said glue applicator includes a heat activatable thermoplastic polymeric glue.

5. An apparatus according to claim 2, further including:

a device, associated with said printer, for advancing the final support material into registration with the layer of glue on the carrier sheet; and a transfer device, positioned to receive the carrier sheet having the final support material in registration therewith, for applying energy to at least said carrier sheet to transfer and adhere the white colored material having the colored pattern thereon to the final support material.

6. An apparatus according to claim 5, wherein the energy being applied by said transfer device includes heat.

7. An apparatus according to claim 5, wherein the energy being applied by said transfer device includes pressure.

8. An apparatus according to claim 5, wherein the final support material includes a fabric.

9. An apparatus according to claim 1, wherein said white colored material includes an adhesive.

10. An apparatus according to claim 1, wherein said printer prints a first layer of colored material on the surface of the carrier sheet and a second layer of colored material with the first layer of colored material being of a different color than the second layer of colored material.

11. An apparatus according to claim 10, wherein said printer prints the first layer and the second layer at least partially in superimposed registration with one another on the carrier sheet.

12. An apparatus according to claim 11, wherein said printer prints the layer of white colored material at least over the first layer and the second layer.

13. An apparatus according to claim 1, wherein said printer includes an electrophotographic printing machine.

14. An apparatus according to claim 1, wherein said printer includes an ink jet printing machine.

15. An apparatus according to claim 1, wherein said digitally controlled color printer prints a transparent layer on the surface of the carrier sheet with the colored pattern being printed thereover.

16. A method of transferring a colored pattern from a carrier sheet to a final support material, including:

using at least one digitally controlled printer to print the colored pattern on a surface of the carrier sheet; and printing a white colored material over at least the colored pattern with the digitally controlled printer.

17. A method according to claim 16, further including applying a layer of glue over the layer of white colored material to form an outer layer.

18. A method according to claim 17, wherein said step of applying includes using the digitally controlled printer to print the layer of glue over the layer of white colored material.

19. A method according to claim 17, wherein said step of applying includes applying a heat activatable thermoplastic polymeric glue.

20. A method according to claim 17, further including:

advancing the final support material into registration with the layer of glue on the carrier sheet; and applying energy to at least the carrier sheet to transfer and adhere the white colored material having the colored pattern to the final support material.

21. A method according to claim 20, wherein said energy applying step includes applying heat.

22. A method according to claim 20, wherein said energy applying step includes applying pressure.

23. A method according to claim 16, wherein the white colored material includes an adhesive.

24. A method according to claim 16, said step of using includes:

printing a first layer of colored material on the surface of the carrier sheet; and printing a second layer of colored material with said first layer of colored material being of a different color than said second layer of colored material.

25. A method according to claim 24, wherein said step of using includes printing the first layer and the second layer at least partially in superimposed registration with one another.

26. A method according to claim 25, wherein said step of printing includes printing the white colored material at least partially in superimposed registration with the first layer and the second layer.

27. A method according to claim 16, wherein said step of using includes an electrophotographic printing machine.

28. A method according to claim 27, step of using an electrophotographic printing machine includes printing the colored pattern with a colored toner material.

29. A method according to claim 16, wherein said step of printing includes printing the white colored material with a white toner material.

30. A method according to claim 16, wherein said step of using includes using an ink jet printing machine.

* * * * *